US005529517A

United States Patent [19]

Hopf et al.

[11] Patent Number: 5,529,517

[45] Date of Patent: Jun. 25, 1996

[54] ELECTRIC SOCKET CONTACT FOR INSERTION INTO A SOCKET HOUSING

[75] Inventors: Gustav Hopf, Schnaittach; Helmut Steinhardt, Nürnberg, both of Germany

[73] Assignee: Framatome Connectors International, Paris, France

[21] Appl. No.: 271,445

[22] Filed: Jul. 7, 1994

[30] Foreign Application Priority Data

Jul. 8, 1993 [DE] Germany ..... 43 22 758.9

[51] Int. Cl.[6] ..... H01R 13/187

[52] U.S. Cl. ..... 439/843; 439/374; 439/851

[58] Field of Search ..... 439/842, 843, 439/851–856, 861, 849, 850, 374, 376, 378

[56] References Cited

U.S. PATENT DOCUMENTS

| | | | |
|---|---|---|---|
| 4,278,317 | 7/1981 | Galluser et al. | 439/843 |
| 4,666,227 | 5/1987 | Galizia et al. | 439/851 |
| 4,707,050 | 11/1987 | Konnemann | 439/851 |
| 5,188,545 | 2/1993 | Hass et al. | 439/851 |

FOREIGN PATENT DOCUMENTS

| | | | |
|---|---|---|---|
| 1294485 | 10/1972 | United Kingdom | 439/843 |

*Primary Examiner*—David L. Pirlot
*Attorney, Agent, or Firm*—Pollock, Vande Sande & Priddy

[57] ABSTRACT

In the case of an electric socket contact for insertion into a socket housing with a sleeve body and a laminated cage, which is attached axially to said sleeve body, for the displaceably pressing reception of a contact pin and attachment means, which are designed at the sleeve body, e.g. crimp extensions for connecting leads, there are for the purpose of making early contact and a reliable central guide of the contact pin the laminated cage (4), which is formed by a cylindrically rolled flat sheet metal blank (6), which exhibits a cylindrical base member (7) with two contact tongues (8), which are punched diametrically to each other and which are bent into the laminated cage in the direction of the free end and then are bent back toward the outside; and a cylindrical annular member (9) reaches at a distance over the free ends (8') near the plug opening (13); and wherein at a distance there are strip elements (14), which are connected rigidly to the annular member (9) and the base member (7) next to the contact tongues (8) and which exhibit depressions (10), hollows or the like, which point in the direction of the center longitudinal axis of the laminated cage, as mechanical guide members for the contact pin (11).

6 Claims, 1 Drawing Sheet

ELECTRIC SOCKET CONTACT FOR INSERTION INTO A SOCKET HOUSING

FIELD OF THE INVENTION

The invention relates to an electric socket contact for insertion into a socket housing with a sleeve body and a laminated cage, which is attached axially to the sleeve body, for the displaceably pressing reception of a contact pin and attachment means, which are designed at the sleeve body, e.g., crimp extensions for connecting leads.

BACKGROUND OF THE INVENTION

In the case of a socket contact it is well known, e.g., from Germany Patent Application No. P35 31 845.7-34, to insert a laminated cage so as to be fixed axially in order to improve the contact in a sleeve body of the socket contact. The ends of the strip-shaped lamellas of the laminated cage are attached to annular strips and the lamellas are over their length the direction of the center longitudinal axis of the laminated cage. When a contact pin is inserted into the laminated cage, the laminated age allows only relatively late contacts and is not suited for preventing the contact pin from tilting and wobbling.

SUMMARY OF THE INVENTION

The object of the invention is to cause for a socket contact of the above type, the contacts near the plug opening and to provide reliable central guidance for the contact pin in the laminated cage.

To this end the laminated cage is formed by a cylindrically rolled flat sheet metal blank, which has a cylindrical base member with two contact tongues which are punched diametrically to each other and which are bent into the laminated cage in the direction of their free ends and then are bent back toward the outside. A cylindrical annular member extends at a distance over the free ends near the plug opening. At a distance there are strip elements, which are connected rigidly to the annular member and the base member next to the contact tongues and which exhibit depressions, hollows or the like, which point in the direction of the center longitudinal axis of the laminated cage, as mechanical guide members for the contact pin. This assures that the contacts between contact pin and socket contact are caused essentially at the start of the plugging operation and that, upon insertion of the contact pin, the latter is prevented from tilting and wobbling motions due to the interaction with the depressions in the laminated cage. The early contacts produced during the insertion operation make the socket contact especially suitable, e.g., for use between a generator and an electronic control device for inflatable retaining systems (airbags) in motor vehicles. As is well known, contacts must be made in these systems before a jumper is lifted off; or the closing movement of the jumper must occur before the contact pin completes the contact with the contact socket. In addition, the socket contact gives a plug-in and plug-out protection for the contact pins owing to the depressions that extend as guide members immediately adjacent to the spring tongues and the prerequisite for relatively tilt-free seating of the contact pin in the laminated cage.

The contact tongues have the same width in the longitudinal direction over their entire length. However, the contact tongues may also have a width, which decreases in the direction of the free end in the longitudinal, direction. Good contact can be obtained when the contact tongues are designed with a width that decreases in the direction of the free end and are defined in the longitudinal direction by means of side faces extending asymmetrically to each other.

For a reliable guidance of the contact pin in the laminated cage, it is finally provided that the depressions extend at least substantially over the entire length of the spring tongues. It is obvious that the depressions can also be designed with sublengths or that the depressions can be effected by means of depression members that are spaced in succession. Furthermore, the laminated cage is axial fixed in position in the sleeve body, so the base member can be braced against a bend, hollow or the like of the sleeve body and that the sleeve body can reach clampingly over the outer edge of the annular element, situated near the plug opening. Thus, the end of the sleeve body can be guided with a short sublength internally over the annular member and forced against the latter. The sleeve body end formed thus results in additional guide surfaces for the contact pin in the region of the plug opening of the socket contact.

BRIEF DESCRIPTION OF THE DRAWINGS

The invention with reference to the accompanying drawings will now be explained.

DETAILED DESCRIPTION

Figure 1:
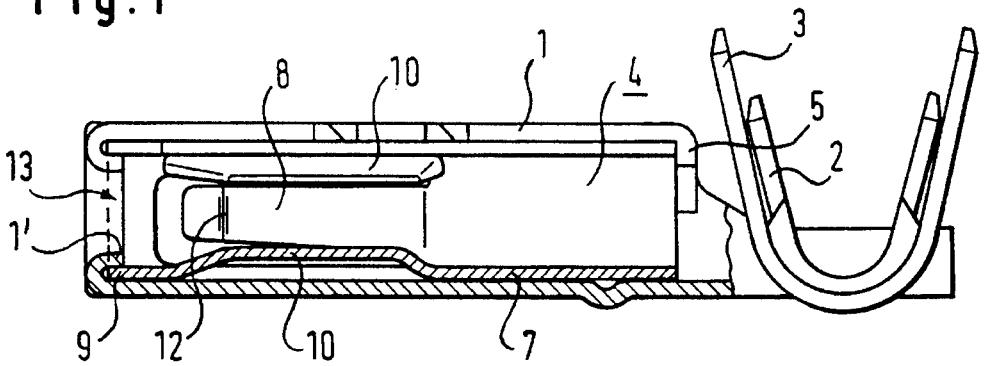
FIG. 1 is a side view, partly in section of a socket contact, according to the invention.
Figure 2:
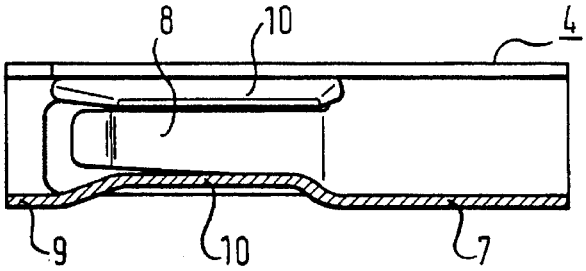
FIG. 2 is a side view, partly in section of a laminated cage.
Figure 3:
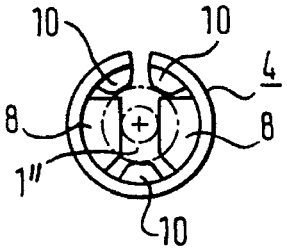
FIG. 3 is a top view of a laminated cage.
Figure 4:
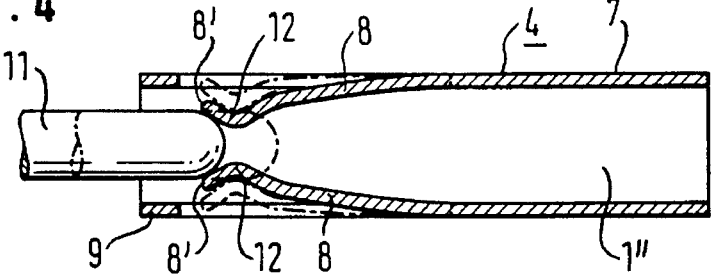
FIG. 4 schematically shows a laminated cage with a contact pin.
Figure 5:
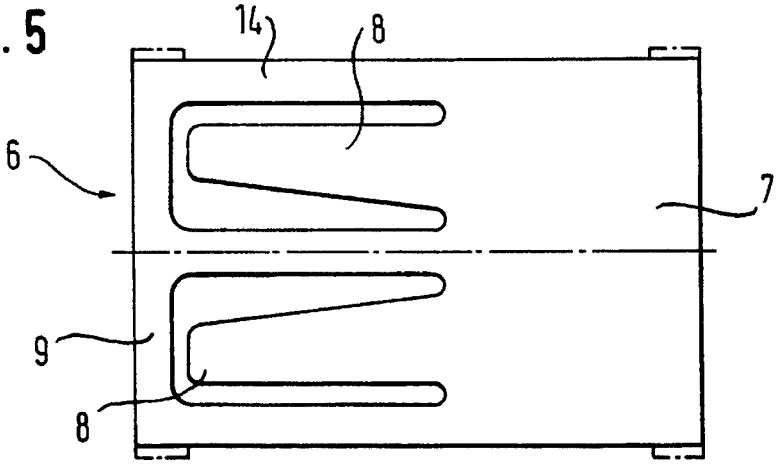
FIG. 5 depicts a blank for forming a laminated cage.

The socket contact comprises a sleeve body 1, to which are attached crimp extensions 2 and 3 for the purpose of connecting connecting leads. A laminated cage 4 is pushed into the sleeve body 1; the inner end of the laminated cage is braced against a bend 5 of the sleeve body 1 in order to attach it axially in the sleeve body; and a bend 1' of the sleeve body 1 reaches clampingly over the outer end of the laminated cage (FIG. 1). The laminated cage 4 can be rolled from a flat blank 6, shown in FIG. 5 comprises a base member 7 and two punched out spring tongues 8. Between the spring tongues 8 are strip elements 14 which rigidly connect the base member 7 to an annular member 9 extending over the free ends of the spring tongues 8. The strip elements 9 are provided with depressions 10, which project as mechanical guide elements for a contact pin 11 into the interior 1" of the laminated cage 4. While in the embodiment of FIG. 1 the depressions 10 extend essentially over the entire length of the spring tongues 8, they may also be in the form of sublengths or segments in rows (not shown). The spring tongues 8 are bent, toward each other and in the direction of the free end, as shown especially in FIG. 4, whereas their free ends 8' form inclines to facilitate the introduction of the contact pin 11 into the laminated cage 4. While the spring tongues 8 may have a uniform width, they are shown as having asymmetrical. The asymmetric shape results in especially reliable contacts.

The contact areas 12 of the spring tongues 8 extend as far as near the plug opening 13, thus enabling the earliest possible contact between contact pin 11 and laminated cage 4 during the plugging operation. Upon insertion of the contact pin 11 (FIG. 4), the contacting commences virtually immediately behind the plug opening 13, thereby spreading the spring tongues outwardly from a narrow position into a wide position. Simultaneously the contact pin 11 makes active contact with the depressions 10, whereby the contact pin can be plugged reliably into the socket contact in a straight line and without wobbling.

We claim:

1. An electric socket contact for insertion into a socket housing with a sleeve body and a laminated cage attached axially to said sleeve body for displaceably pressing reception of a contact pin and attachment means, said sleeve body being attached to extensions for connecting leads, wherein said laminated cage is formed from a cylindrically rolled flat sheet metal blank comprising a cylindrical base member with two contact tongues extending diametrically opposite to each other and bent into said laminated cage in the direction of the free end and then bent back outwardly, and a cylindrical annular member spaced from and extending over said free ends adjacent a plug opening, and strip elements spaced from said contact tongues and rigidly connected to said annular member and said base member adjacent to said contact tongues and which comprise depressions projecting towards the central longitudinal axis of said laminated cage and constituting mechanical guide means for said contact pin.

2. The socket contact according to claim 1, wherein said contact tongues have a uniform width in a longitudinal direction over an entire length of said contact tongues.

3. The socket contact according to claim 1, wherein said contact tongues have a decreasing width in a direction of said free end in a longitudinal direction.

4. The socket contact according to claim 1, wherein said contact tongues have a decreasing width in a direction of said free end and are delimited in a longitudinal direction by side faces extending asymmetrically to each other.

5. The socket contact according to claim 1, wherein said depressions extend substantially over the entire length of said spring tongues so as to project into said laminated cage.

6. The socket contact according to claim 1, wherein for axial fixing in position in the sleeve body, said base member of said laminated cage is braced against a bend of said sleeve body, and wherein an end of said sleeve body extends clampingly over an outer edge of said annular member facing away from said base member.

* * * * *